US006199491B1

(12) United States Patent
Wu

(10) Patent No.: US 6,199,491 B1
(45) Date of Patent: Mar. 13, 2001

(54) REFUSE INCINERATING OVEN

(76) Inventor: Kun-Cheng Wu, No. 9, Lane 301, Kuo-Hua St., Chia-Yi City (TW)

( * ) Notice: Subject to any disclaimer, the term of this patent is extended or adjusted under 35 U.S.C. 154(b) by 0 days.

(21) Appl. No.: 09/569,785

(22) Filed: May 12, 2000

(51) Int. Cl.[7] ..... F23J 15/00; F23B 5/00; F23G 5/00; F23G 5/12; F23G 5/44

(52) U.S. Cl. ..... 110/235; 110/203; 110/210; 110/211; 110/215; 110/238; 110/255; 110/259; 110/289; 110/165 R; 110/167; 110/170; 432/241

(58) Field of Search ..... 110/346, 345, 110/203, 235, 210, 211, 215, 238, 255, 259, 267, 286, 289, 322, 165 R, 166, 167; 432/170, 241

(56) References Cited

U.S. PATENT DOCUMENTS

| | | | | |
|---|---|---|---|---|
| 3,064,593 | * | 11/1962 | Burk et al. | 110/8 |
| 4,223,614 | * | 9/1980 | Barkhuus et al. | 110/238 |
| 4,252,553 | * | 2/1981 | Pircon et al. | 71/37 |
| 4,338,507 | * | 7/1982 | Scott | 219/121 PC |
| 4,356,778 | * | 11/1982 | McRee | 110/244 |
| 4,502,462 | * | 3/1985 | Lawrence | 126/77 |
| 4,515,089 | * | 5/1985 | Ehrlichmann | 110/235 |
| 4,944,236 | * | 7/1990 | Sheen | 110/257 |
| 4,949,653 | * | 8/1990 | Rast | 110/235 |
| 5,069,147 | * | 12/1991 | Tan et al. | 110/349 |
| 5,160,707 | * | 11/1992 | Murray et al. | 422/170 |
| 5,288,195 | * | 2/1994 | McIntyre | 414/400 |
| 5,423,271 | * | 6/1995 | Schulze | 110/237 |
| 5,802,993 | * | 9/1998 | Meador | 110/345 |
| 6,024,032 | * | 2/2000 | Sharpe | 110/342 |

* cited by examiner

*Primary Examiner*—Denise L. Ferensic
*Assistant Examiner*—Ken B. Rinehart
(74) *Attorney, Agent, or Firm*—Merchant & Gould P.C.

(57) ABSTRACT

A refuse incinerating oven includes a refuse loading car, and a furnace body with lower and upper combustion chambers. The car is conveyed through the furnace body such that refuse loaded on the car can be ignited in the lower combustion chamber. The combustion exhaust generated in the lower combustion chamber flows into and is heated in the upper combustion chamber. A spraying tank is communicated with the upper combustion chamber for receiving the combustion exhaust. Water mist is sprayed to the combustion exhaust in the spraying tank so as to generate aerated water. The aerated water and the combustion exhaust flowing from the spraying tank are cooled as they flow into a reservoir. The aerated water is pumped from the reservoir to an upper end of a waterfall tank so as to generate a downwardly cascading water stream inside the waterfall tank. An exhaust port unit is connected to the upper end of the waterfall tank for sucking and releasing the combustion exhaust.

18 Claims, 9 Drawing Sheets

REFUSE INCINERATING OVEN

BACKGROUND OF THE INVENTION

1. Field of the Invention

This invention relates to a refuse incinerating oven, more particularly to a refuse incinerating oven which generates combustion exhaust with less toxic content.

2. Description of the Related Art

In recent years, industrial waste and refuse are usually disposed by incineration. During incineration, the resulting combustion exhaust is released to the atmosphere via a stack of the incinerator. However, the combustion exhaust usually contains toxic substances, such as dioxines, and thus causes serious air pollution.

SUMMARY OF THE INVENTION

Therefore, the object of the present invention is to provide a refuse incinerating oven which generates combustion exhaust with less toxic content.

Accordingly, the refuse incinerating oven includes at least one refuse loading car adapted for loading refuse thereon. A furnace body has a car inlet, a car outlet, a lower combustion chamber disposed between and communicated with the car inlet and the car outlet, and an upper combustion chamber disposed above and communicated with the lower combustion chamber. Conveying means is provided for conveying the refuse loading car through the furnace body from the car inlet to the car outlet. Igniting means is provided in the lower combustion chamber of the furnace body for igniting the refuse loaded on the car when the car is conveyed through the furnace body. Gas heating means is provided in the upper combustion chamber for heating combustion exhaust generated when burning the refuse in the lower combustion chamber. A spraying tank is communicated with the upper combustion chamber for receiving the combustion exhaust. Spraying means is provided in the spraying tank for spraying water mist to the combustion exhaust in the spraying tank so as to generate aerated water in the spraying tank. Cooling means is connected to the spraying tank for cooling the aerated water and the combustion exhaust flowing from the spraying tank. Reservoir means is connected to the cooling means for receiving the aerated water and the combustion exhaust flowing from the cooling means. A waterfall tank has a lower end communicated with the reservoir means, and an upper end disposed at an elevation higher than that of the reservoir means. Pumping means is provided for pumping the aerated water from the reservoir means to the upper end of the waterfall tank and for releasing the aerated water at the upper end of the waterfall tank so as to generate inside the waterfall tank a downwardly cascading water stream that falls back into the reservoir means via the lower end of the waterfall tank. An exhaust port unit is connected to the upper end of the waterfall tank for sucking the combustion exhaust from the waterfall tank and for releasing the combustion exhaust.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
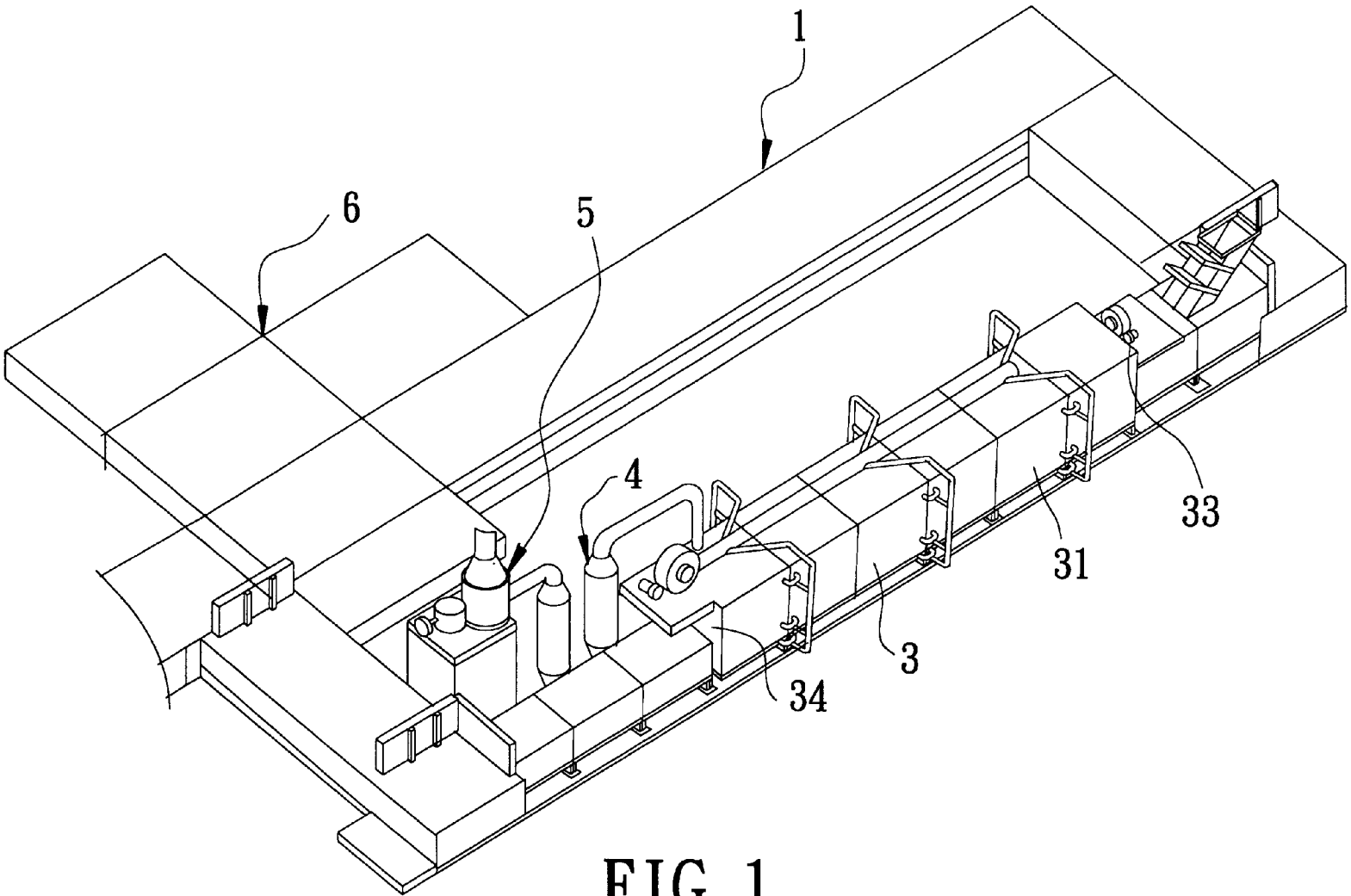
FIG. 1 is a perspective view showing a preferred embodiment of the refuse incinerating oven of the present invention.
Figure 2:
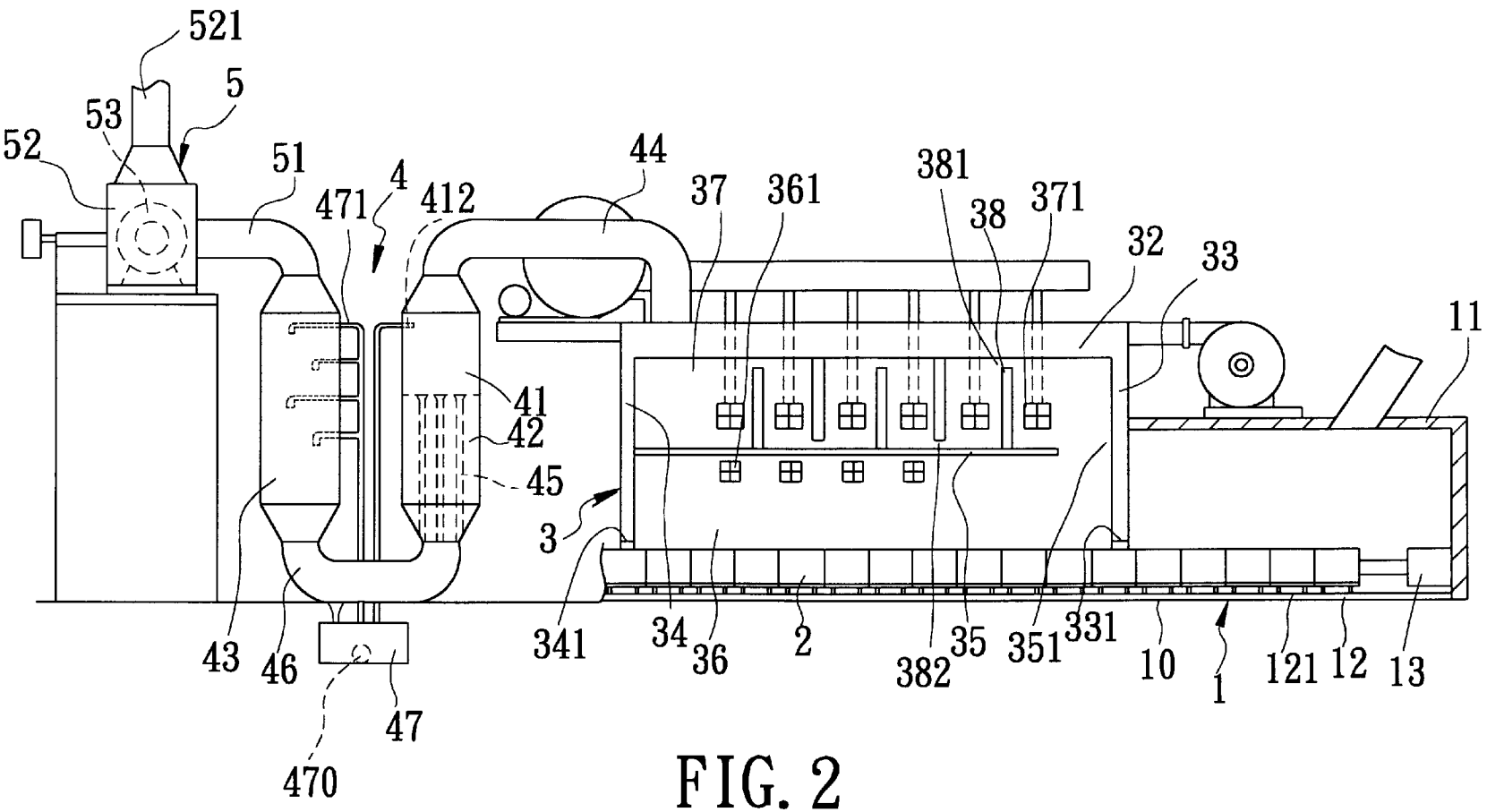
FIG. 2 is a fragmentary schematic view of the preferred embodiment.
Figure 3:
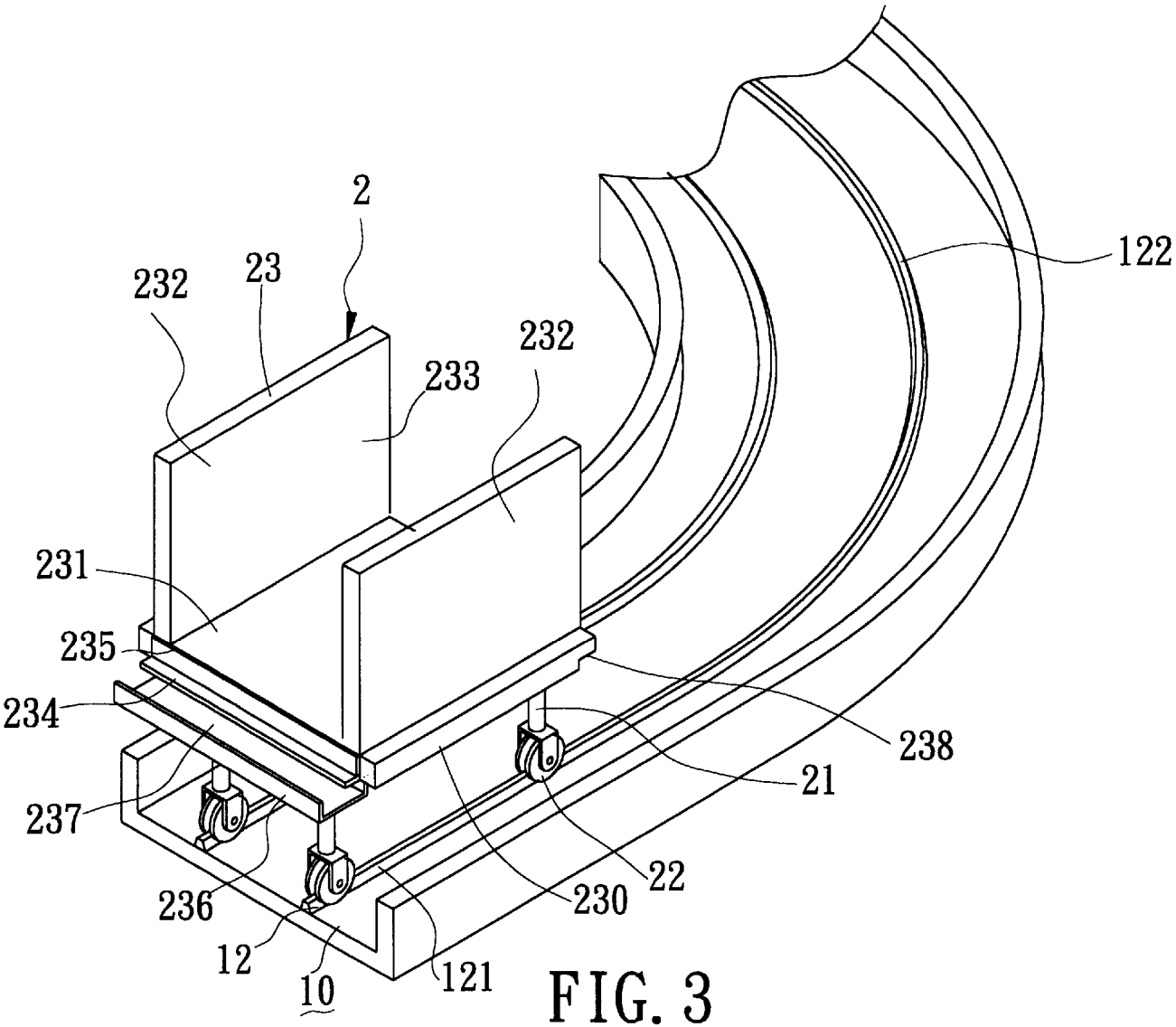
FIG. 3 is a fragmentary perspective view illustrating a refuse loading car and a rail member of the preferred embodiment.

The refuse incinerating oven of the present invention is adapted for disposing industrial waste and refuse and polluted mud in rivers and lakes. Referring to FIGS. 1 to 3, the preferred embodiment of the refuse incinerating oven of the present invention is shown to include a conveying unit 1, a plurality of refuse loading cars 2, a furnace body 3, an exhaust disposal unit 4, an exhaust port unit 5, and a residue removing unit 6.

The conveying unit 1 includes a looped conveying channel 10 filled with water therein, a rail member 12 extending along the conveying channel 10, and a cover 11 for covering the conveying channel 10. The rail member 12 has a starting section 121 and an ending section 122 connected to the starting section 121.

The cars 2 are arranged in succession along the rail member 12, and are disposed on the rail member 12 in the channel 10 so as to be movable along the rail member 12. A first push mechanism 13 is provided at the starting section 121 for pushing the cars 2 to move along the channel 10 from the starting section 121 toward the ending section 122. Each of the refuse loading cars 2 has a leg frame 21 provided with wheels 22 for moving on the rail member 12. The wheels 22 are immersed in the water that fills the channel 10 to prevent damage to the wheels 22 due to the high temperature in the furnace body 3. Each of the refuse loading cars 2 has a refuse loading portion 23 formed with a refuse loading space 233. The refuse loading portion 23 includes a horizontal base plate 231 mounted on the leg frame 21, and a parallel pair of lateral side plates 232 which extend upwardly from the base plate 231 and which cooperate with the base plate 231 to confine the refuse loading space 233. The refuse loading space 233 is thus open at front, rear and top sides thereof. The base plate 231 has lateral edge portions formed with guiding projections 230 which project relative to the side plates 232, respectively. The height of the refuse loading portion 23 of each of the cars 2 is preferably lower than 0.6 meter to ensure complete combustion of the refuse loaded therein. In the present embodiment, the size of the refuse loading portion 23 is 1.8 m×1.0 m×0.25 m.

Figure 5:
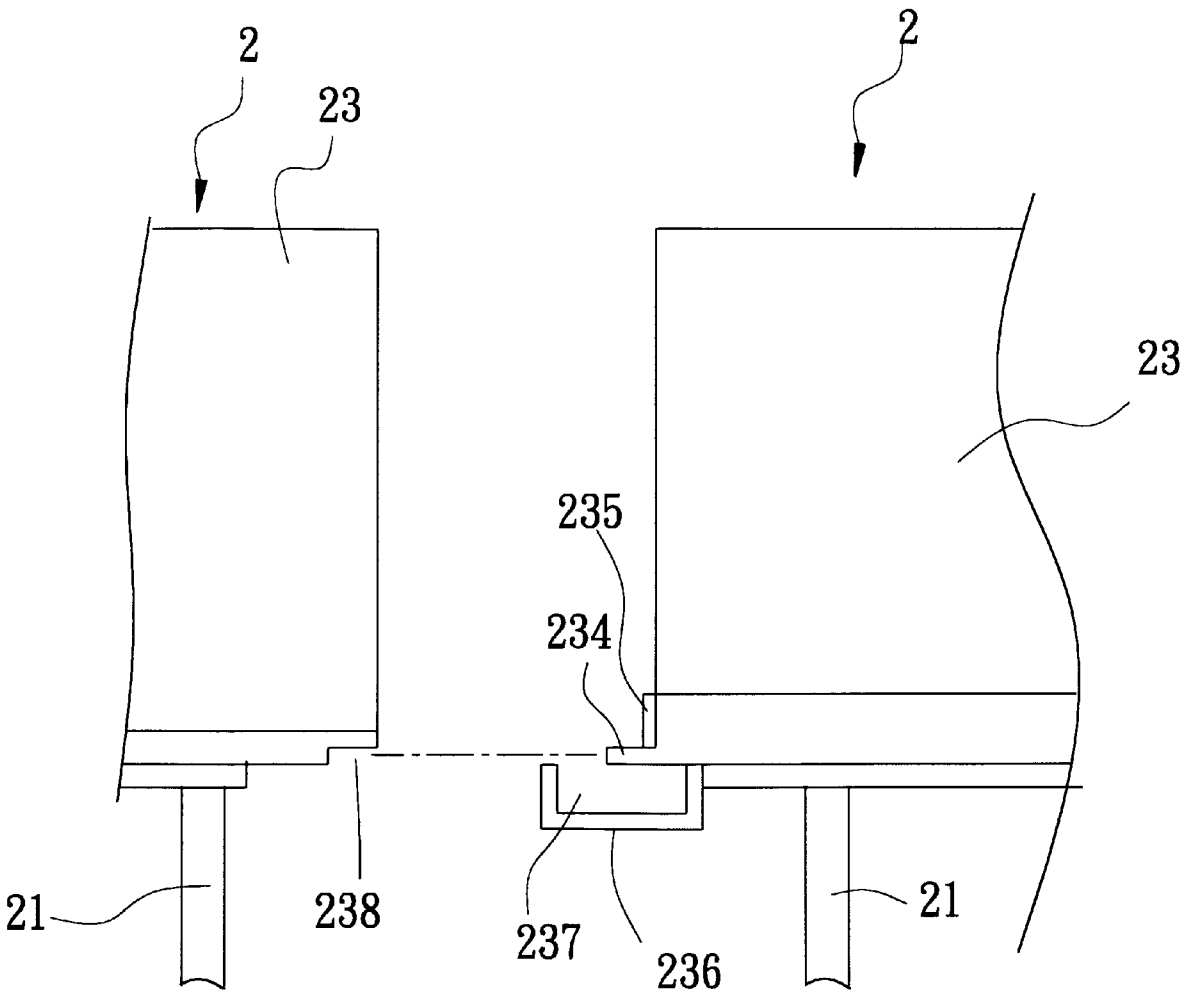
FIG. 5 is a schematic view illustrating the arrangement of two adjacent refuse loading cars of the preferred embodiment.

Referring to FIGS. 3 and 5, the base plate 231 of each of the refuse loading cars 2 is provided with a heat-resistant bumper strip 235 at a front end thereof, and a projecting rib 234 that projects forwardly from the front end. An elongated collecting member 236 is secured to the front end of the base plate 231 at a bottom side thereof, and projects forwardly relative to and is disposed below the projecting rib 234. The collecting member 236 has a U-shaped cross-section, and confines a collecting cavity 237 that opens upwardly. The base plate 231 of each of the refuse loading cars 2 is further formed with an indented portion 238 at a rear end thereof for receiving fittingly the projecting rib 234 on a succeeding one of the refuse loading cars 2 such that the rear end is in contact with the bumper strip 235 on the succeeding one of the refuse loading cars 2. The collecting member 236 collects refuse that fall from the two adjacent refuse loading cars 2 to prevent the refuse from dropping into the conveying channel 10.

Figure 6:
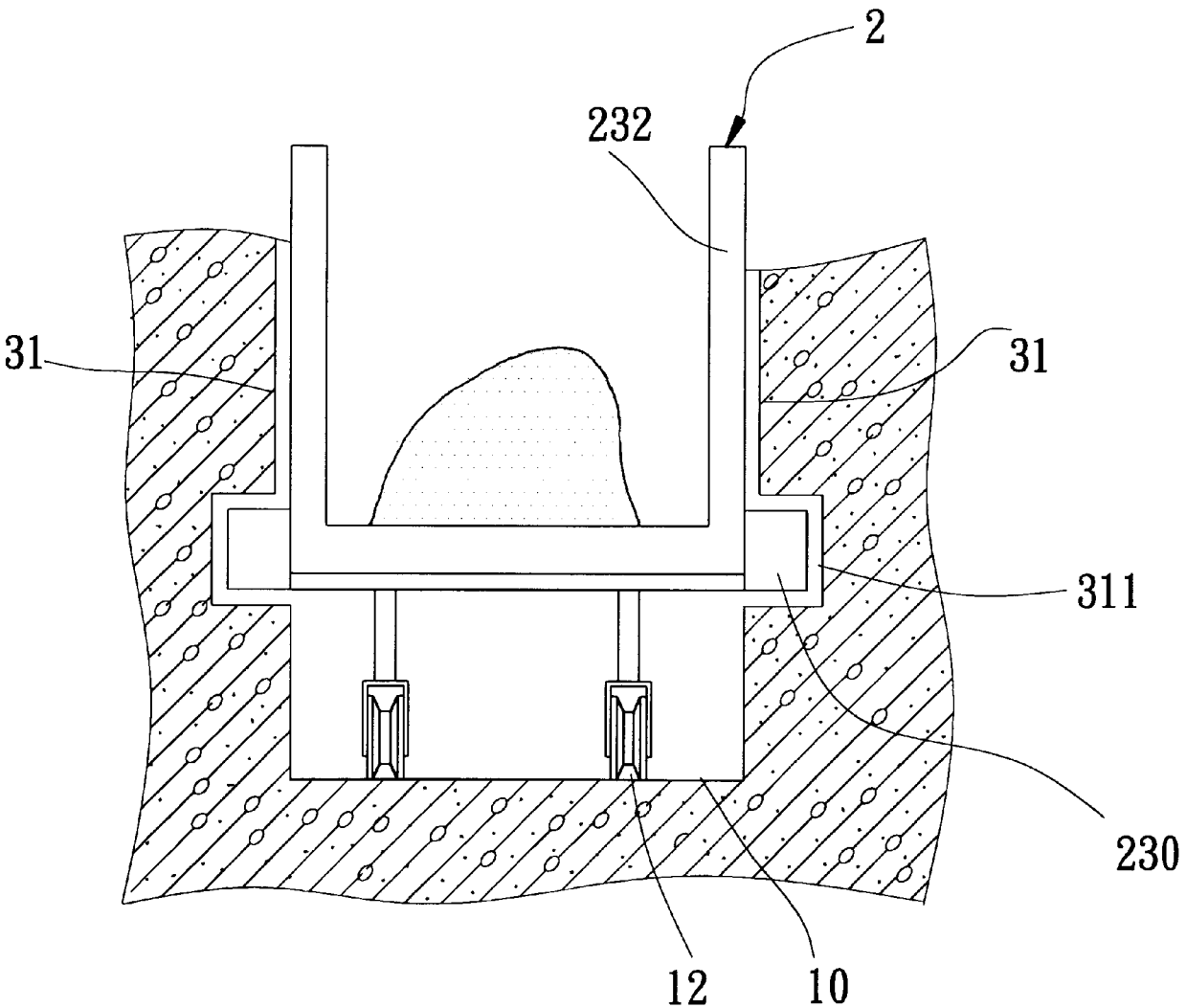
FIG. 6 is a schematic view illustrating one of the refuse loading cars when conveyed through a furnace body of the preferred embodiment.

Referring to FIGS. 1, 2 and 6, the furnace body 3 is built over the rail member 12 near the starting section 121, and is constructed from fire bricks. The furnace body 3 is about 30 meters in length, and includes a parallel pair of side walls 31 which are formed with guiding grooves 311 for extension of the guiding projections 230 on the refuse loading cars 2 thereinto. The furnace body 3 further has a top wall 32 interconnecting upper ends of the side walls 31, a front end wall 33 proximate to the starting section 121 of the rail member 12 and formed with a car inlet 331 that permits entry of the refuse loading cars 2 into the furnace body 3, a rear end wall 34 opposite to the front endwall 33 and formed with a car outlet 341 that permits exit of the refuse loading cars 2 from the furnace body 3, and a horizontal partition 35 for dividing an interior of the furnace body 3 into an upper combustion chamber 37 and a lower combustion chamber 36. The partition 35 has a rear end connected to the rear end wall 34, and a front end that forms a clearance 351 with the front end wall 33. The clearance 351 communicates the lower combustion chamber 36 with the upper combustion chamber 37. The lower combustion chamber 36 is provided with a plurality of igniting members 361 on the side walls 31. The igniting members 361 can spray combustion fuel onto the refuse loaded on the refuse loading cars 2 that enter into the furnace body 3 for igniting the refuse. The upper combustion chamber 37 is provided with a plurality of vertical heating plates 38 that are spaced-apart from one another for heating the combustion exhaust that is generated when burning the refuse in the lower combustion chamber 36. In this embodiment, each of the first, third, and fifth ones of the heating plates 38 has a lower end secured to the partition 35, and an upper end spaced apart from the top wall 32 so as to define an upper air passage 381 with the top wall 32. Each of the second and fourth ones of the heating plates 38 has an upper end secured to the top wall 32, and a lower end spaced apart from the partition 35 so as to define a lower air passage 382 with the partition 35. The upper combustion chamber 37 is provided with a plurality of burning members 371 on the side walls 31 for heating the heating plates 38.

The exhaust disposal unit 4 is built adjacent to the furnace body 3 for processing the combustion exhaust released from the furnace body 3. The exhaust disposal unit 4 includes a spraying tank 41 having an upper end communicated with the upper combustion chamber 37 via a first pipe member 44 for receiving the combustion exhaust flowing from the upper combustion chamber 37. Spraying means 412 is provided in the spraying tank 41 for spraying water mist to the combustion exhaust flowing into the spraying tank 41 so as to generate aerated water in the spraying tank 41. A cooling tank 42 has an upper end connected to a lower end of the spraying tank 41, and is provided with passage tubes 45 communicated with the spraying tank 41 to permit passage of the aerated water and the combustion exhaust from the spraying tank 41 therethrough. The cooling tank 42 is provided with condensing means that contains circulating condensing water for cooling the combustion exhaust and the aerated water flowing through the passage tubes 45. The passage tubes 45 are communicated with one end of a reservoir pipe 46 at a lower end of the cooling tank 42 to allow the aerated water and the combustion exhaust to flow into the reservoir pipe 46. A reservoir tank 47 is disposed below and is communicated with the reservoir pipe 46 for receiving the aerated water. An upright waterfall tank 43 has a lower end connected to and communicated with another end of the reservoir pipe 46. An upper end of the waterfall tank 43 is disposed at an elevation significantly higher than that of the reservoir tank 47. A pump 470 and a multi-ended delivery pipe 471 are provided for pumping the aerated water in the reservoir tank 47 to the upper end of the waterfall tank 43 and for releasing the aerated water at the upper end of the waterfall tank 43 so as to generate inside the waterfall tank 43 a downwardly cascading water stream that falls back into the reservoir pipe 46 and the reservoir tank 47 via the lower end of the waterfall tank 43.

The exhaust port unit 5 is connected to the upper end of the waterfall tank 43 via a second pipe member 51, and includes a fan casing 52 mounted with an air drawing fan 53, and a port member 521 extending upwardly from the fan casing 52. The air drawing fan 53 generates a back pressure at the upper end of the waterfall tank 43 for sucking the combustion exhaust from the waterfall tank 43 and for releasing the combustion exhaust through the port member 521. Preferably, the back pressure is in the range of 0.8 to 0.9 atm. When the back pressure is below 0.8 atm, the flow rate of the combustion exhaust is too high and can have an adverse effect on the decomposition and cooling thereof. When the back pressure is higher than 0.9 atm, the combustion exhaust cannot flow smoothly through the exhaust disposal unit 4 and the exhaust port unit 5.

Figure 4:
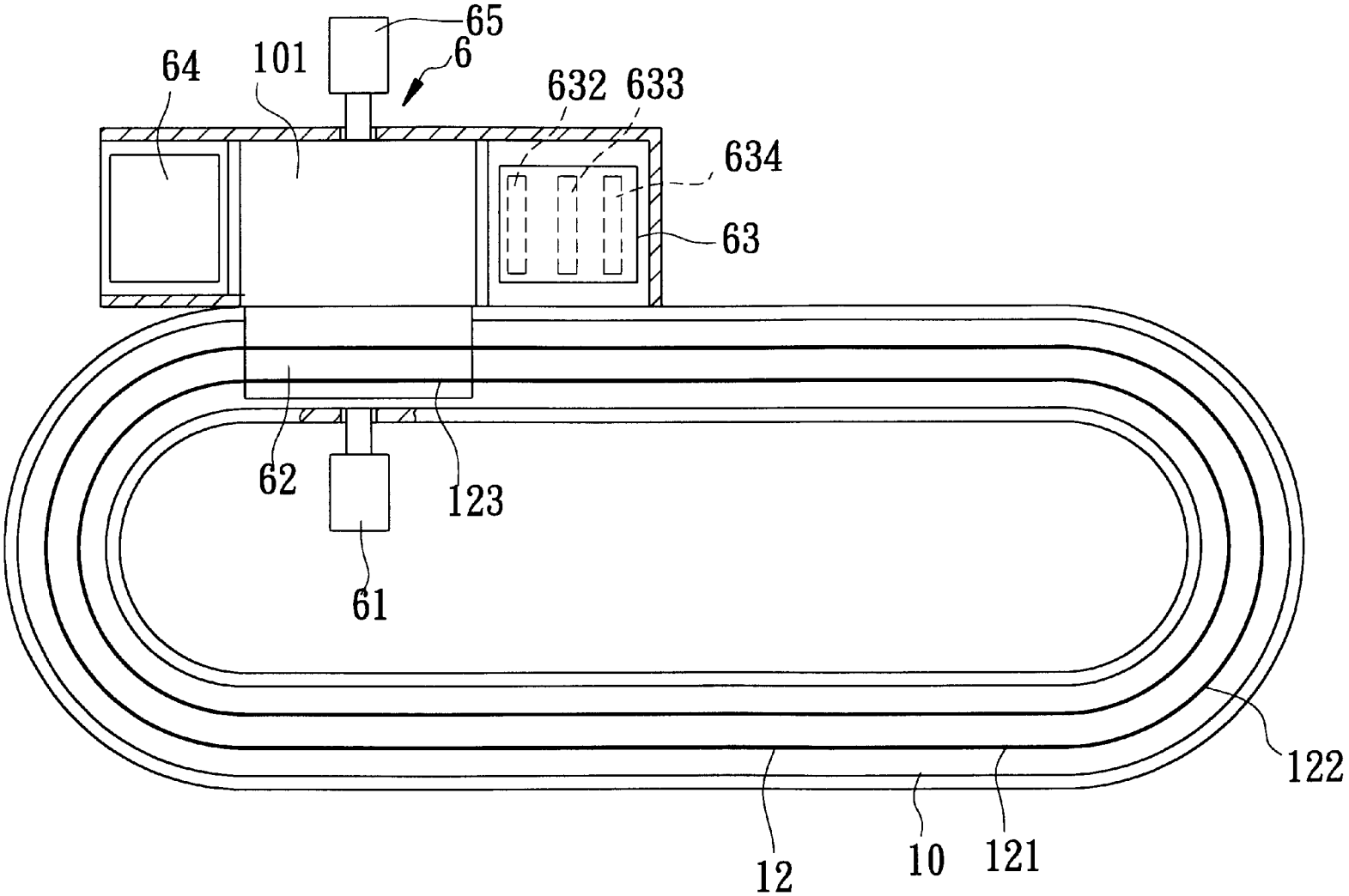
FIG. 4 is a schematic top view illustrating a residue removing unit of the preferred embodiment.
Figure 7:
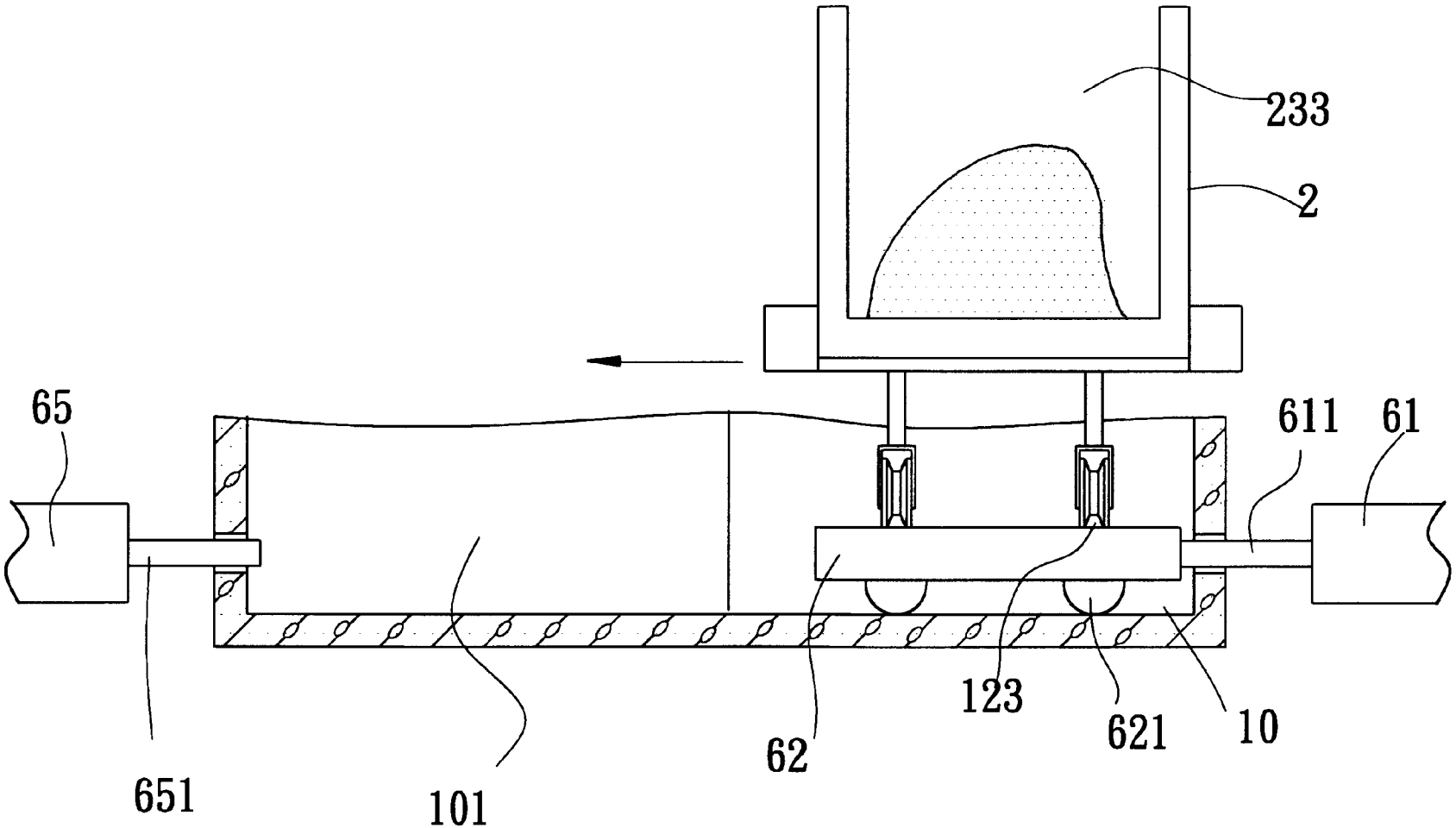
FIG. 7 is a schematic view illustrating how the refuse loading car is brought into a residue removing unit of the preferred embodiment.
Figure 8:
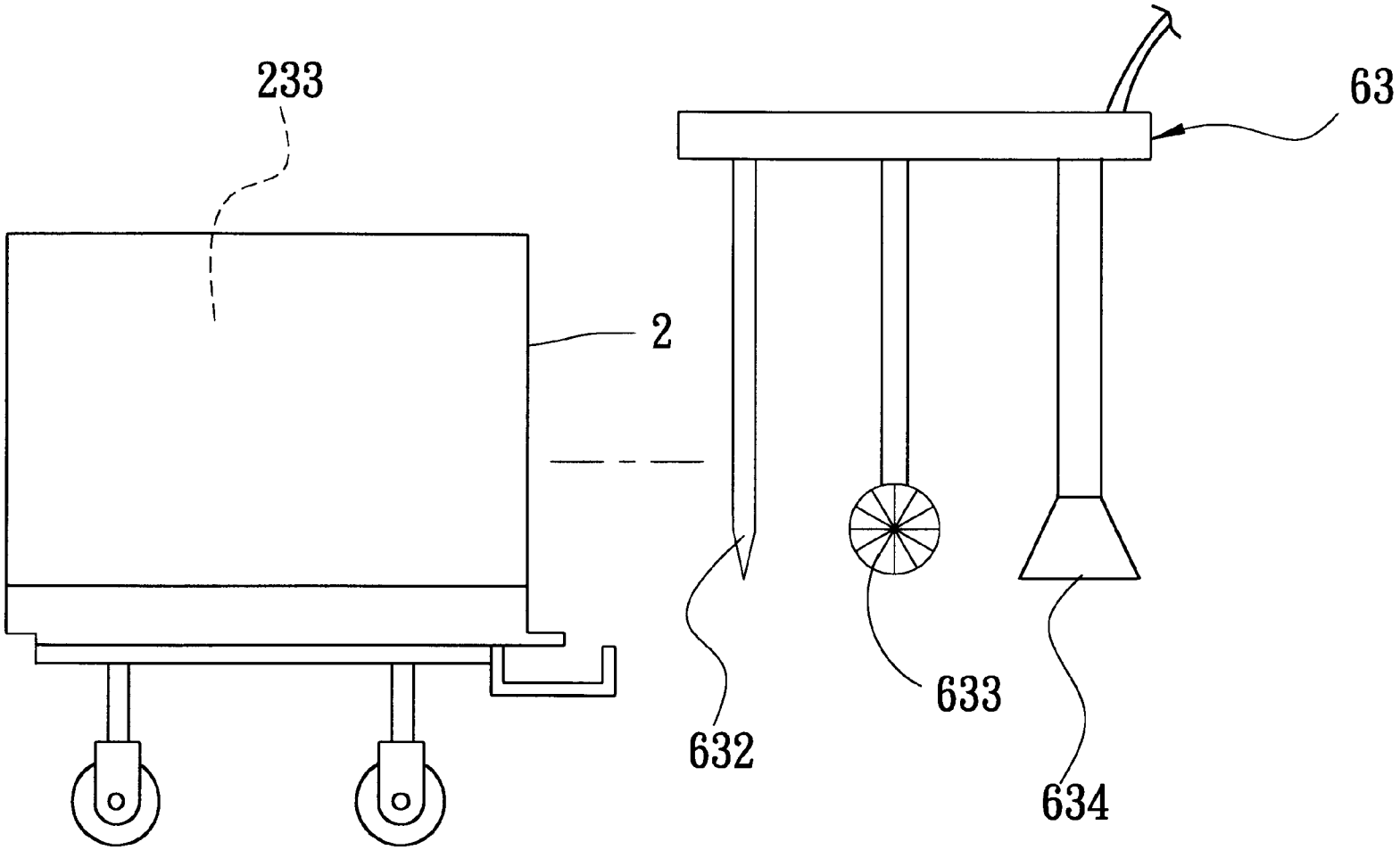
FIG. 8 is a schematic view illustrating operation of a residue cleaner of the residue removing unit of the preferred embodiment.

Referring to FIGS. 4, 7 and 8, the rail member 12 has a movable section 123 which is formed on a movable platform 62 that is provided with wheels 621 on its bottom side. The residue removing unit 6 has an operating space 101 formed adjacent to the rail member 12 to permit movement of the platform 62 thereinto. The residue removing unit 6 further has a residue cleaner 63 and a residue collector 64 which are disposed on opposite front end rear sides of the operating space 101. Each of the refuse loading cars 2, after exiting from the furnace body 3 via the car outlet 341 (see FIG. 2) , is conveyed to the movable section 123 on the platform 62 for moving together with the platform 62 into and out of the operating space 101. A second push mechanism 61 is provided inside the channel 10, and has a push rod 611 for pushing the platform 62 to move into the operating space 101. A third push mechanism 65 is provided adjacent to the operating space 101 opposite to the second push mechanism 61, and is provided with a push rod 651 for pushing the platform 62 to move out of the operating space 101 and back into the channel 10. The residue cleaner 63 includes a scraping plate 632, a brush 633 and a vacuuming member 634. During operation of the residue removing unit 6, the residue cleaner 63 moves into the refuse loading space 233 from the open front side thereof when the refuse loading car 2 is brought into the operating space 101. The scraping plate 632 scrapes the combustion residue on the refuse loading car 2 into the residue collector 64. The brush 633 brushes the combustion residue away from the refuse loading car 2 and into the residue collector 64. The vacuuming member 634 vacuums the remaining combustion residue from the refuse loading car 2 to complete the residue removing operation.

Referring to FIG. 2, the refuse incinerating oven of the present embodiment operates in the following manner: Initially, a plurality of successively arranged refuse loading cars 2 are loaded with refuse from above at the starting section 121 of the rail member 12, and are pushed intermittently by the first push mechanism 13 to move along the rail member 12 and into the furnace body 3 via the car inlet 331. The igniting members 361 in the lower combustion chamber 36 spray combustion fuel onto the refuse loading cars 2, and light a flame in the lower combustion chamber 36 for igniting the refuse loaded on the refuse loading cars 2. The burning time is preferably about 1 hour to prevent incomplete combustion. Moreover, during burning of the refuse, the air drawing fan 53 is activated to generate a back pressure in the range from 0.8 to 0.9 atm to facilitate the flow of the combustion exhaust generated in the lower combustion chamber 36 into the upper combustion chamber 37 via the clearance 351. At this time, the heating plates 38 in the upper combustion chamber 37 are heated by the burning members 371 in order to heat the combustion exhaust flowing into the upper combustion chamber 37. The combustion exhaust, while being heated by the heating plates 38, flow through the upper and lower air passages 381, 382 and toward the first pipe member 44. The temperatures and operating periods in the upper and lower combustion chambers 37, 36 depend upon the type of refuse to be disposed. Generally, the temperature in the lower combustion chamber 36 is controlled to be between 900 to 1500° C., whereas the temperature in the upper combustion chamber 37 is controlled to be between 1200 to 1800° C. For example, in the case the refuse to be disposed is mercury-containing mud, the lower combustion chamber 36 is controlled to a temperature of 900° C., while the upper combustion chamber 37 is controlled to a temperature of 1200° C. In the case the refuse to be disposed is plastic, the temperature in the lower combustion chamber 36 is raised to about 1200° C., and the temperature in the upper combustion chamber 37 is raised to about 1500° C. The burning time in the upper combustion chamber 37 for heating the combustion exhaust is generally controlled to about 7 seconds.

Referring to FIGS. 1, 2 and 4, after the burning operation in the furnace body 3, combustion residue is left on the refuse loading cars 2. The refuse loading cars 2 are conveyed to exit the furnace body 3 via the car outlet 341 due to the intermittent pushing action of the first push mechanism 13, and toward the residue removing unit 6. When one of the refuse loading cars 2 is moved onto the platform 62, it is brought into the operating space 101 together with the platform 62 due to the operation of the second push mechanism 61. At this time, the residue cleaner 63 moves into the refuse loading space 233 for moving a large part of the residue into the residue collector 64 and for vacuuming the remaining part of the residue and ash via the vacuuming member 634. Thereafter, the car 2 is brought out of the operating space 101 together with the platform 62 due to the operation of the third push mechanism 65, and is brought back into the channel 10 for moving along the rail member 12. When the car 2 is conveyed back to the starting section 121 through the ending section 122 of the rail member 12, refuse is loaded once again into the refuse loading space 233 thereof for preparation of a subsequent incinerating operation.

On the other hand, referring again to FIG. 2, the combustion exhaust heated in the upper combustion chamber 37 flows through the first pipe member 44 and into the spraying tank 41. The spraying means 412 sprays water mist to the combustion exhaust in the spraying tank 41. The resulting aerated water and the combustion exhaust then flow through the cooling tank 42 for cooling by the condensing means in the cooling tank 42, and subsequently flow into the reservoir pipe 46. The aerated water is collected in the reservoir tank 47 below the reservoir pipe 46, while the combustion exhaust flows continuously into the waterfall tank 43 from the lower end to the upper end of the waterfall tank 43 due to the sucking action of the air drawing fan 53. The aerated water collected in the reservoir tank 47 is pumped and delivered to the upper end of the waterfall tank 43 by means of the pump 470 and the delivery pipe 471 that extends into the waterfall tank 43, and is released at the upper end of the waterfall tank 43. The combustion exhaust thus passes through the downwardly cascading water stream generated in the waterfall tank 43. In this manner, the temperature of the combustion exhaust can drop from about 900° C. to 200° C., within about 0.5 second. That is, the temperature of the combustion exhaust drops rapidly through the range of 400° C. to 250° C., within which carbon, hydrogen, and chlorine can be prevented from combining to form water non-dissolvable and toxic substances, such as dioxines. Moreover, by virtue of colliding with and heating by the heating plates 38 in the upper combustion chamber 37, molecules of the combustion exhaust can be decomposed into smaller molecules, most of which mix with water when passing through the spraying tank 41, and are then collected in the reservoir tank 47.

In the case the refuse to be disposed is liquidwaste, the waste is received in a container having a size corresponding with that of the refuse loading space 233 of the refuse loading car 2, and the container is disposed in the refuse loading space 233. In this situation, the residue removing unit 6 is not activated.

Figure 9:
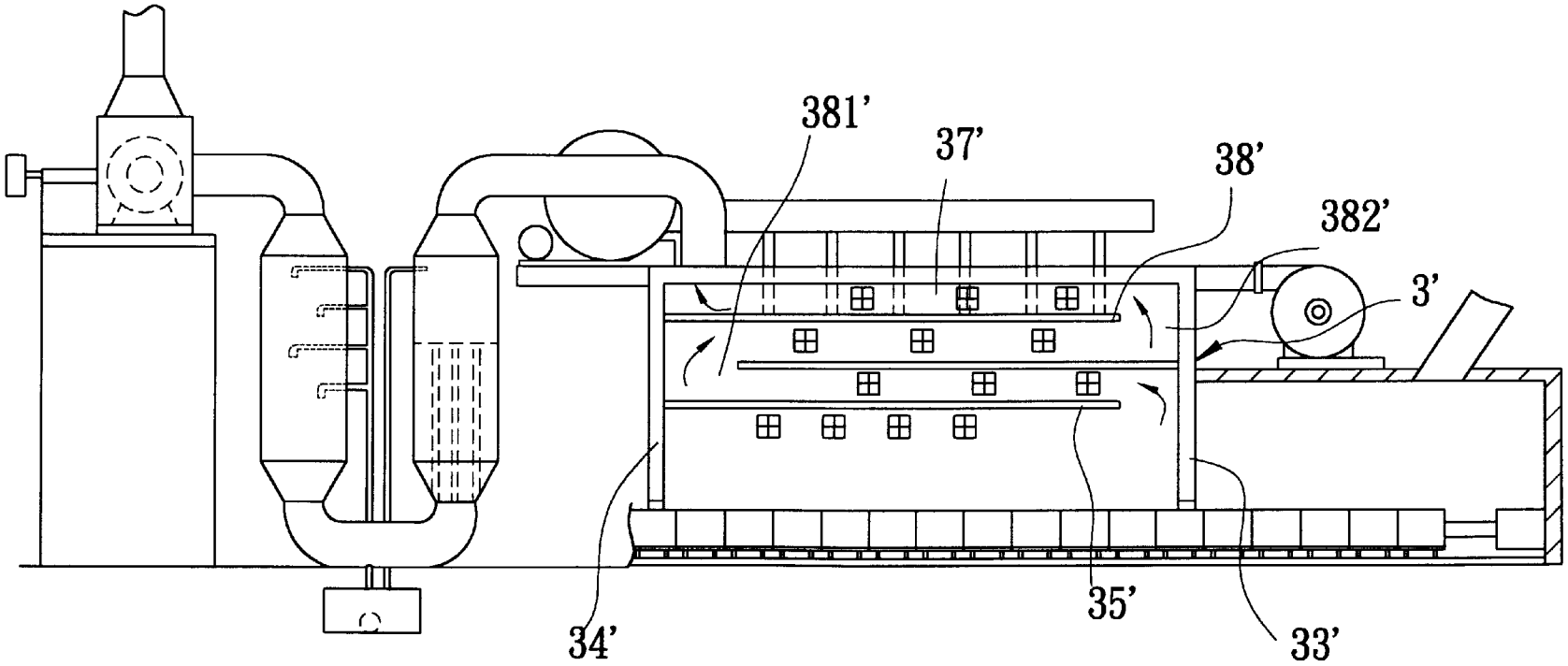
FIG. 9 is a fragmentary schematic view of a modified embodiment of the refuse incinerating oven of the present invention.

Referring to FIG. 9, in a modified embodiment, the heating plates 38' in the upper combustion chamber 37' of the furnace body 3' are disposed horizontally above and parallel to the partition 35'. As shown, a lower one of the heating plates 38' is secured to the front end wall 33' of the furnace body 3', and defines a rear air passage 381' with a rear end wall 34' of the furnace body 3'. An upper one of the heating plates 38' is secured to the rear end wall 34' of the furnace body 3', and defines a front air passage 382' with the front end wall 33'.

It has thus been shown that, the exhaust disposal unit 4 enables the temperature of the combustion exhaust to drop rapidly so as to prevent generation of harmful and toxic substances in the combustion exhaust. As such, the combustion exhaust released from the port member 521 has less toxic content to prevent serious pollution of the atmosphere.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A refuse incinerating oven, comprising:

at least one refuse loading car adapted for loading refuse thereon;

a furnace body having a car inlet, a car outlet, a lower combustion chamber disposed between and communicated with said car inlet and said car outlet, and an upper combustion chamber disposed above and communicated with said lower combustion chamber;

conveying means for conveying said refuse loading car through said furnace body from said car inlet to said car outlet;

igniting means provided in said lower combustion chamber of said furnace body for igniting the refuse loaded on said car when said car is conveyed through said furnace body;

gas heating means provided in said upper combustion chamber for heating combustion exhaust generated when burning the refuse in said lower combustion chamber;

a spraying tank communicated with said uppers combustion chamber for receiving the combustion exhaust;

spraying means provided in said spraying tank for spraying water mist to the combustion exhaust in said spraying tank so as to generate aerated water in said spraying tank;

cooling means connected to said spraying tank for cooling the aerated water and the combustion exhaust flowing from said spraying tank;

reservoir means connected to said cooling means for receiving the aerated water and the combustion exhaust flowing from said cooling means;

a waterfall tank having a lower end communicated with said reservoir means, and an upper end disposed at an elevation higher than that of said reservoir means;

pumping means for pumping the aerated water from said reservoir means to said upper end of said waterfall tank and for releasing the aerated water at said upper end of said waterfall tank so as to generate inside said waterfall tank a downwardly cascading water stream that falls back into said reservoir means via said lower end of said waterfall tank; and an exhaust port unit connected to said upper end of said waterfall tank for sucking the combustion exhaust from said waterfall tank and for releasing the combustion exhaust.

2. The refuse incinerating oven of claim 1, wherein said exhaust port unit generates a back pressure at said upper end of said waterfall tank.

3. The refuse incinerating oven of claim 2, wherein the back pressure is in the range of 0.8 to 0.9 atm.

4. The refuse incinerating oven of claim 1, wherein said conveying means includes a conveying channel and a rail member disposed in said conveying channel, said car being disposed in said conveying channel on said rail member and being movable along said rail member.

5. The refuse incinerating oven of claim 4, wherein said conveying channel is filled with water.

6. The refuse incinerating oven of claim 4, wherein said rail member has a starting section and an ending section connected to said starting section, said conveying means further including a push mechanism for pushing said refuse loading car to move from said starting section along said rail member to said ending section.

7. The refuse incinerating oven of claim 1, wherein said refuse loading car includes a wheeled leg frame, a horizontal base plate mounted on said leg frame, and a pair of spaced-apart side plates extending upwardly from said base plate and cooperating with said base plate to define a refuse loading space.

8. The refuse incinerating oven of claim 7, wherein said base plate of said refuse loading car has a pair of lateral guiding projections that project relative to said side plates, said furnace body having a pair of side walls between which said refuse loading car passes, said side walls being formed with guiding grooves that permit said guiding projections to extend slidably thereinto when said refuse loading car is conveyed into said furnace body.

9. The refuse incinerating oven of claim 1, comprising a plurality of said refuse loading cars that are arranged in succession, each of said refuse loading cars having a front end formed with a bumper strip and a projecting rib that projects forwardly, and a rear end formed with an indented portion for receiving said projecting rib of a succeeding one of said refuse loading cars when said rear end is in contact with said bumper strip at said front end of the succeeding one of said refuse loading cars.

10. The refuse incinerating oven of claim 1, wherein said gas heating means includes a plurality of spaced apart and parallel heating plates mounted in said upper combustion chamber for heating the combustion exhaust.

11. The refuse incinerating oven of claim 10, wherein said gas heating means further includes burning means for heating said heating plates.

12. The refuse incinerating oven of claim 1, further comprising a residue removing unit adapted for removing combustion residue from said refuse loading car, said conveying unit further conveying said refuse loading car to said residue removing unit when said refuse loading car exits said furnace body via said car outlet.

13. The refuse incinerating oven of claim 12, wherein said residue removing unit includes a movable platform, said conveying unit conveying said refuse loading car onto said movable platform when said refuse loading car exits said furnace body via said car outlet.

14. The refuse incinerating oven of claim 13, wherein said residue removing unit further includes an operating space, push means for pushing said movable platform into and out of said operating space, a residue collector to be disposed adjacent to said refuse loading car when said refuse loading car is moved together with said platform into said operating space, and a residue cleaner adapted for moving the combustion residue on said refuse loading car into said residue collector.

15. The refuse incinerating oven of claim 14, wherein said residue cleaner includes a scraping plate adapted for scraping the combustion residue on said refuse loading car into said residue collector.

16. The refuse incinerating oven of claim 14, wherein said residue cleaner includes a brush adapted for brushing the combustion residue away from said refuse loading car.

17. The refuse incinerating oven of claim 14, wherein said residue cleaner includes a vacuuming member adapted for vacuuming the combustion residue from said refuse loading car.

18. The refuse incinerating oven of claim 5, wherein said conveying channel is a looped conveying channel.

* * * * *